US006273057B1

(12) United States Patent
Schwoerer et al.

(10) Patent No.: US 6,273,057 B1
(45) Date of Patent: Aug. 14, 2001

(54) HYDRAULICALLY-ACTUATED FAIL-SAFE STROKE-LIMITING PISTON

(75) Inventors: John A. Schwoerer, Storrs, CT (US); Eric Day, Longmeadow, MA (US)

(73) Assignee: Diesel Engine Retarders, Inc., DE (US)

( * ) Notice: Subject to any disclaimer, the term of this patent is extended or adjusted under 35 U.S.C. 154(b) by 0 days.

(21) Appl. No.: 09/377,598

(22) Filed: Aug. 19, 1999

Related U.S. Application Data

(60) Provisional application No. 60/097,113, filed on Aug. 19, 1998.

(51) Int. Cl.[7] ..... F02D 13/04

(52) U.S. Cl. ..... 123/321; 123/90.12; 123/90.46

(58) Field of Search ..... 123/320, 321, 123/90.12, 90.13, 90.46

(56) References Cited

U.S. PATENT DOCUMENTS

| | | | |
|---|---|---|---|
| 3,220,392 | 11/1965 | Cummins . | |
| 4,050,435 | 9/1977 | Fuller et al. . | |
| 4,164,917 | 8/1979 | Glasson . | |
| 4,399,787 | 8/1983 | Cavanagh . | |
| 4,423,712 | 1/1984 | Mayne et al. . | |
| 4,552,172 | 11/1985 | Krieger et al. . | |
| 4,662,332 | 5/1987 | Bergmann et al. . | |
| 4,711,210 | 12/1987 | Reichenbach . | |
| 4,793,307 | 12/1988 | Quenneville et al. . | |
| 4,848,289 | 7/1989 | Meneely . | |
| 4,932,372 | 6/1990 | Meneely . | |
| 4,957,275 | 9/1990 | Homes . | |
| 5,000,145 | 3/1991 | Quenneville . | |
| 5,036,810 | 8/1991 | Meneely . | |
| 5,048,480 | 9/1991 | Price . | |
| 5,048,489 | 9/1991 | Fischer et al. . | |
| 5,105,782 | 4/1992 | Meneely . | |
| 5,161,500 | 11/1992 | Kubis et al. . | |
| 5,161,501 | 11/1992 | Hu . | |
| 5,183,018 | 2/1993 | Vittorio et al. . | |
| 5,186,141 | 2/1993 | Custer . | |
| 5,201,290 | 4/1993 | Hu . | |
| 5,379,737 | 1/1995 | Hu . | |
| 5,386,809 | 2/1995 | Reedy et al. . | |
| 5,451,029 | 9/1995 | Krüger . | |
| 5,460,131 | 10/1995 | Usko . | |
| 5,462,025 | 10/1995 | Israel et al. . | |
| 5,511,460 | 4/1996 | Custer . | |
| 5,531,192 | 7/1996 | Feucht et al. . | |
| 5,586,533 | 12/1996 | Feucht . | |
| 5,595,158 | 1/1997 | Faletti et al. . | |
| 5,787,858 * | 8/1998 | Meneely | 123/321 |
| 5,787,859 | 8/1998 | Meistrick et al. . | |
| 5,809,964 | 9/1998 | Meistrick et al. . | |

* cited by examiner

*Primary Examiner*—Erick Solis
(74) *Attorney, Agent, or Firm*—Collier Shannon Scott, PLLC

(57) ABSTRACT

An apparatus for limiting the travel of a slave piston (110) in a slave piston cylinder (100) in a compression release engine brake is disclosed. The apparatus provides stroke-limiting means and independent lash adjustment means which may be installed in a common rail, variable valve actuation system. The independent lash adjustment means comprises a sleeve (300) around the slave piston (110), threadably mounted in the brake housing (40). The stroke-limiting means comprises a slave piston (110) in a slave piston cylinder (100), a trigger valve (90) and a hydraulic circuit connected thereto. The slave piston stroke is limited when a lower flow port (130) in the slave piston cylinder (100) is opened to drain (81) slightly before high-pressure flow is cut off through an upper flow port (120) in the slave piston cylinder (100).

27 Claims, 4 Drawing Sheets

HYDRAULICALLY-ACTUATED FAIL-SAFE STROKE-LIMITING PISTON

CROSS-REFERENCE TO RELATED PATENT APPLICATION

This application relates to and claims priority on United States Provisional Application Serial No. 60/097,113 filed Aug. 19, 1998 and entitled "Hydraulically Activated Fail-Safe Stroke-Limiting Piston."

FIELD OF THE INVENTION

The present invention relates generally to compression release brakes for internal combustion engines. In particular, the present invention is directed to a high-pressure, decompression braking system with high-speed actuation and means that allows independent adjustment of the slave piston lash and the maximum slave piston stroke.

BACKGROUND OF THE INVENTION

Compression release-type engine brakes are well-known in the art. Engine brakes or retarders are designed to temporarily convert an internal combustion engine of either the spark ignition or compression ignition type into an air compressor. The fundamental braking power is achieved by preventing fuel injection during the compression stroke of a piston, compressing the captured air mass, and releasing the compressed air at or near a top-dead-center position of a piston into an exhaust manifold. The energy expended in compression release braking systems is controlled, for the most part, by the volume of gas compressed, the timing of the release of the gas into the exhaust manifold and the amount of gas released. A compression release brake decreases the kinetic energy of an engine by opposing the upward motion of the engine's pistons on the compression stroke. As a piston travels upward on its compression upstroke, the gases that are trapped in the cylinder are compressed. The compressed gases oppose the upward motion of the piston. When the piston nears the top of its stroke, an exhaust valve is opened to "release" the compressed gases. The pressure having been released from the cylinder, the piston cannot recapture the energy stored in the compressed gases on the subsequent expansion downstroke. In so doing, the engine develops retarding power to help slow down the vehicle. This provides the operator with increased control over the vehicle.

A properly designed and adjusted compression release-type engine retarder can develop retarding power that is a substantial portion of the power developed by the engine on positive power. Compression release-type retarders of this type supplement the braking capacity of the primary vehicle wheel braking system. In so doing, these retarders may substantially extend the life of the primary wheel braking system of the vehicle.

The basic design of a compression release type engine retarding system is disclosed in U.S. Pat. No. 3,220,392 to Cummins, which is incorporated herein by reference. The compression release-type engine brake disclosed in the Cummins patent employs a hydraulic control system to operate the exhaust valves to effect the compression release event. The hydraulic control system engages the engine's existing valve actuation system, namely, the rocker arms of the engine.

When the engine is operating under positive power, the hydraulic control system of the compression release retarder is disengaged from the valve control system, so that no compression release event occurs. When compression release retarding is desired, the engine is deprived of fuel and the hydraulic control system of the compression release brake engages the valve activation system of the engine. The valve activation system drives the compression release brake to produce compression release events at the appropriate times.

Typically, it is desirable to use the compression release-type engine retarder to open an engine exhaust valve as late in the engine cycle as possible. In this way, the engine develops greater compression, allowing more energy to be dissipated through the compression release retarder. Delaying the opening of the exhaust valve in the compression release event, however, may substantially increase the loading on critical engine components. The force required to open the exhaust valve during the compression release event is transmitted back through the hydraulic system.

In a compression release engine retarder it is desirable to provide accurate timing of exhaust valve opening. To this end, it is advantageous in these systems to apply sharp hydraulic pulses to the slave pistons so that they open the exhaust valves rapidly. In order to both stop the slave pistons' motion and prevent excessive opening of the associated exhaust valves, stroke-limiting mechanisms have been employed to reduce the hydraulic fluid pressure when either the hydraulic fluid pressure reaches the predetermined maximum or the slave pistons have reached the end of their desired stroke. The term stroke-limiting generally refers to modification of the forward motion of the slave piston in order to limit the total travel of the slave piston or to reduce the length of the slave motion event. The disadvantages of excessive slave piston travel include excessive exhaust valve travel and possible contact of exhaust valves with the engine piston, increased overall braking apparatus and engine height, and overtravel of the slave piston return spring.

In the present invention, Applicants have designed an innovative slave piston for a common rail, variable valve actuation system. The present invention has been designed to overcome limitations in stroke-limiting and lash adjustment design found in the prior art.

There are several categories of stroke-limiting designs for common rail variable valve actuation systems. One design relies on precise trigger valve timing to avoid valve-to-piston contact. This design may be unacceptable with respect to potential failure modes. Other designs that use hard stops with oil squeeze films may have difficulty meeting long range durability requirements, considering start-up conditions when there could be insufficient oil in the squeeze film. Still other designs that limit the stroke only by bleeding high-pressure oil behind the slave piston have excessive oil utilization and require an unacceptable increase in the capacity of the high-pressure pump. Other designs that employ a separate stroke-limiting piston in addition to the slave piston are excessively complex. Additionally, designs having an occluding orifice on the slave piston side of the stroke-limiting piston are not fail-safe with respect to degradation of the flow metering edges. Designs that cut off the flow only to the slave piston, such as U.S. Pat. No. 5,531,192 assigned to Caterpillar, are not suitable for decompression braking because valve-to-piston contact could result from entrained air or check valve failure. The present design avoids the risk of valve-to-piston contact due to entrained air or failure of a check valve.

The electronically-controlled, common rail, decompression braking system of the present invention provides variable timing of the opening of the engine exhaust valve to optimize retarding power. The present invention comprises a high-pressure common rail, high-speed electronic trigger valve, means of stroke limiting, and slave piston positioned over the engine exhaust valve or cross head. Opening the trigger valve routes high-pressure hydraulic fluid to a plenum above the slave piston, which displaces the slave piston and opens the exhaust valve. The displacement of the engine exhaust valve must be limited to avoid valve-to-piston contact. Closing the trigger valve connects the slave piston plenum to drain pressure, which causes the slave piston and the exhaust valve to close.

The present invention is directed to a stroke-limiting slave piston design in which the travel of the slave piston is limited by dropping the pressure above the slave piston to drain combined with the force of the exhaust valve and slave piston springs. Dropping the slave piston pressure to drain while the trigger valve is open is accomplished by closing the port between the slave piston plenum and the trigger valve while opening a port between the slave piston plenum and drain. The port flow areas are defined by the mating of grooves, circumferentially-arranged holes, or slots in the slave piston and slave piston cylinder. The flow area versus piston displacement characteristics are built-in and fail-safe. They are defined to provide acceptable valve overshoot, pressure spikes, and utilization of high-pressure oil. Opening the passage to drain slightly before the high-pressure flow is completely cut off provides significant advantages compared to prior art with respect to potential failure modes, tolerance to entrained air in the hydraulic fluid, risk of cavitation damage, design simplicity, and cost. Positioning the lower flow port in the slave piston cylinder so that the lower flow port opens before or at approximately the same piston displacement as the upper flow port is completely occluded serves to eliminate the check valve, which is otherwise needed to ensure that the piston does not get stuck at a displacement at which the upper flow port is fully occluded. There is also a reduction in component cost from elimination of the check valve.

The flow area of the upper and lower ports is designed to vary as a function of slave piston longitudinal position in order to provide: rapid opening of the engine valve, minimal overshoot of the engine valve relative to the desired maximum stroke, acceptable peak pressure in the fluid line between the trigger valve and the upper port, acceptable time for the slave piston to return to its initial longitudinal position after the trigger valve is switched to connect the upper port to drain, and acceptably low average flow of high-pressure oil from the common rail. These flow area profiles may be implemented by the mating of one or two annular channels (or undercuts) with a plurality of circumferentially-arranged holes or slots in the slave piston or slave piston cylinder. In a preferred embodiment, there is a single annular channel (or undercut) on the slave piston and, for both the upper and lower ports, a plurality of circumferentially-arranged holes or slots in the slave piston cylinder (sleeve). An alternative embodiment may have annular channels (undercuts) in the slave piston cylinder for both the upper and lower ports and a plurality of circumferentially-arranged holes or slots in the slave piston.

The present invention includes a means for setting the slave piston lash without affecting the built-in slave piston stroke. This independent lash adjustment means may comprise a sleeve threaded into the brake housing, which is bolted to the engine, to allow lash adjustment and additionally, some means, such as a locking ring, of ensuring that the position does not change as a result of vibration and cyclic loading. The sleeve may be made of steel. The connection to the upper port may be sealed on either side by O-rings or other seals around the sleeve to prevent leakage when the trigger valve is positioned to connect the upper port to the high-pressure common rail. In a preferred embodiment, there are holes in the sleeve connecting the volume between the top of the slave piston and the sleeve with the volume between the top of the sleeve and the housing bore in which the sleeve is disposed. The purpose of these holes is to transmit the load required to open the engine valve to the housing. The sleeve is designed to be partially pressure-balanced to reduce the forces on the threads and so that the net pressure force will not act in a direction which could loosen the locking ring. An advantage of a steel sleeve design is that the edges which define the flow areas which provide the stroke limiting function are more durable than the iron casting of the housing. An optional element is a stroke-adjustment screw in the top of the sleeve.

An alternate design of the present invention provides a hydraulic lash adjusting feature. The independent lash adjustment means may comprise a fixed sleeve provided in the brake housing, a hydraulic lash adjustor piston, an additional plenum between the hydraulic lash adjustor piston and the slave piston, additional hydraulic lash adjustor springs to urge the hydraulic lash adjustor piston upward, and a check valve in the oil supply line to retain the oil in the lash adjustor plenum when the engine exhaust valve is opened by the slave piston. The lash adjustor may be supplied by engine lubricating oil switched by a control valve, which is open when the engine retarder is switched on. When this control valve is open and the engine exhaust valve is closed, engine lubricating oil flows into the lash adjustor plenum and urges the lash adjustor piston down, taking up the lash in the valve train. The lash adjustor is designed so that the engine lubricating oil supply pressure will overcome the lash adjustor spring but will not overcome the engine valve springs. When the engine exhaust valve is opened by the slave piston, the hydraulic lash adjustor check valve retains the oil in the hydraulic lash adjustor plenum. The hydraulic lash adjustor piston must be sized large enough to handle the high loads associated with opening the exhaust valve near top center of the engine compression stroke for engine retarding. When the engine retarder is switched off, the control valve in the supply line to the hydraulic lash adjustor is closed, and oil leaks slowly out of the hydraulic lash adjustor plenum due to the force of the hydraulic lash adjustor springs.

The present invention limits motion in a common rail, variable valve actuation system to avoid contact between the engine valve and engine piston. The most stringent requirements for stroke limiting are for decompression braking where a large force is required to open the engine exhaust valve, the cylinder pressure force is reduced to nearly zero as the exhaust valve is opened, and the exhaust valve is opened near top-dead-center. The market demands that such a design must be fail-safe, durable, and low cost. The present invention meets these needs and provides other benefits as well.

OBJECTS OF THE INVENTION

It is therefore object of the present invention to provide an improved slave piston strokelimiting apparatus.

It is another object of the present invention to limit the travel of a slave piston in a compression release engine brake.

It is yet another object of the present invention to provide a simple apparatus for limiting the travel of a slave piston in a compression release engine brake.

It is a further object of the present invention to limit the travel of a slave piston in a compression release engine brake so that the associated engine exhaust valves do not contact the engine piston.

It is another object of the present invention to provide stroke-limiting which is fail-safe, durable, and low cost.

It is yet another object of the present invention to provide a design that provides acceptable overshoot, pressure spikes, and utilization of high pressure oil.

It is still another object of the present invention to provide a design that does not rely on trigger valve timing to effect stroke limiting.

It is a further object of the present invention to provide a design that performs acceptably with entrained air in the hydraulic fluid.

It is yet another object of the present invention to provide a stroke-limiting mechanism which reduces the risk of cavitation damage.

It is another object of the present invention to provide a design that does not degrade and allow an increase in exhaust valve stroke over long range use with a decompression braking duty cycle.

It is still another object of the present invention to provide a design that does not require a check valve to limit stroke It is another object of the present invention to provide means for adjusting the slave piston lash independent of limiting the maximum slave piston stroke.

Additional objects and advantages of the invention are set forth, in part in the description which follows and, in part, will be apparent to one of ordinary skill in the art from the description and/or from the practice of the invention.

SUMMARY OF THE INVENTION

In response to the foregoing challenge, Applicants have developed an innovative and economical apparatus for limiting the travel of a slave piston in a slave piston cylinder and for providing variable timing of the opening of the engine exhaust valve to optimize retarding power in a compression release engine retarder. The apparatus comprises a slave piston in a slave piston cylinder, the slave piston having a head and a stem disposed thereon and the slave piston cylinder having a wall and being connected to a hydraulic circuit so that when hydraulic fluid passes through the wall of the slave piston cylinder at an upper end of the slave piston cylinder, the slave piston moves down along a longitudinal axis toward a lower end of the slave piston cylinder to actuate at least one engine valve.

The apparatus may further comprise an upper flow port in the slave piston cylinder wall, the upper flow port forming an entrance to a hydraulic fluid supply line; a lower flow port in the slave piston cylinder wall, the lower flow port forming an entrance to a drain passage; an internal passageway in the slave piston head, the internal passageway providing communication between a fluid volume above said slave piston, the hydraulic fluid supply line and the drain passage; and an electronic trigger valve connected to a common rail, high-pressure plenum, to the upper flow port via the hydraulic fluid supply line and to the drain passage. The trigger valve may be a three-way, high-pressure, high-speed trigger valve.

The apparatus may further comprise a slave piston spring disposed in the slave piston cylinder and biased to urge the slave piston generally upward against the pressure in the hydraulic circuit. The head of the slave piston may be slidably disposed in the upper end of the slave piston cylinder, and the stem of the slave piston may extend longitudinally from the slave piston head into the lower end of the slave piston cylinder. The slave piston head may further comprise an annular channel providing, in a first position, communication of the fluid volume with the upper flow port and occlusion of the lower flow port, and in a second position, opening of the lower flow port while the upper flow port is nearly occluded, to thereby permit communication between the fluid volume above the slave piton and the drain passage. A first flow area of the upper flow port and a second flow area of the lower flow port may vary as a function of the longitudinal position of the slave piston. The annular channel may further comprise a plurality of circumferentially-arranged holes or a plurality of circumferential grooves. The internal passageway may further comprises a plenum disposed generally in the slave piston head, at least one vertical bore disposed in the slave piston head parallel with the longitudinal axis of the slave piston cylinder, and at least one horizontal bore diametrically spanning the slave piston head, such that the at least one horizontal bore communicates with the slave piston plenum, the at least one vertical bore and the annular channel.

The apparatus may further comprise an automatic lash adjustment hydraulic system for adjusting the lash of the slave piston. The automatic lash adjustment hydraulic system may further comprise: a hydraulic lash adjustor piston slidably disposed inside the slave piston; a hydraulic lash adjustor spring disposed about the a hydraulic lash adjustor piston to urge the hydraulic lash adjustor piston upward; a hydraulic lash adjustor plenum between the slave piston and the hydraulic lash adjustor piston; a check valve between the hydraulic lash adjustor plenum and the hydraulic circuit; and a control valve connected to said hydraulic circuit.

An embodiment of the present invention comprises an apparatus in a compression release engine retarder for adjusting the lash of a slave piston in a slave piston cylinder, the slave piston having a head and a stem disposed thereon and the slave piston cylinder, disposed in a brake housing, having a wall and being connected to a hydraulic circuit so that when hydraulic fluid passes through the wall of the slave piston cylinder at an upper end of the slave piston cylinder, the slave piston moves down along a longitudinal axis of the slave piston cylinder toward a lower end of the slave piston cylinder to actuate at least one engine valve. The apparatus may further comprise a sleeve disposed around the slave piston and contained substantially in the brake housing; and means for maintaining the sleeve in an adjusted position, connected to the sleeve.

In this embodiment, the sleeve may further comprise a first set of threads and the brake housing further comprises a second set of threads, the first and second sets of threads being capable of alignment thereby to screw the sleeve into the brake housing. The sleeve may extend above the brake housing, the sleeve extension further comprising a continuation of the first set of threads. The apparatus may further comprise a locking ring threadably engaged to the sleeve extension, for securing the sleeve in an adjusted position. The sleeve may further comprise at least one vertical bore disposed in the sleeve extension parallel with the longitudinal axis of the slave piston cylinder. The apparatus may further comprise at least one hold-down bolt for securing the sleeve in an adjusted position and a plurality of shims of varying thickness for adjusting the lash of the slave piston. The apparatus may further comprises an adjusting screw threadably engaged with the sleeve.

The present invention may further comprise an apparatus, in a compression release engine retarder having a common rail, variable valve actuation system, for limiting the travel and adjusting the lash of a slave piston in a slave piston cylinder, the slave piston having a head and a stem disposed thereon and the slave piston cylinder, disposed in a brake housing, having a wall and being connected to a hydraulic circuit so that when hydraulic fluid passes through the wall of the slave piston cylinder at an upper end of the slave piston cylinder, the slave piston moves down along a longitudinal axis toward a lower end of the slave piston cylinder to actuate at least one engine valve. The apparatus may further comprise: an upper flow port in the slave piston cylinder wall, the upper flow port forming an entrance to a hydraulic fluid supply line; a lower flow port in the slave piston cylinder wall, the lower flow port forming an entrance to a drain passage; a slave piston spring disposed in the slave piston cylinder and biased to urge the slave piston generally upward against the pressure in the hydraulic circuit; the slave piston head, slidably disposed in the upper end of the slave piston cylinder, having an annular channel; the slave piston stem, extending longitudinally from the slave piston head into the lower end of the slave piston cylinder; an internal passageway in the slave piston, comprising a plenum disposed generally in the slave piston head, at least one vertical bore disposed in the slave piston head parallel with the longitudinal axis of the slave piston cylinder, and at least one horizontal bore diametrically spanning the slave piston head, such that the at least one horizontal bore communicates with the plenum, the at least one vertical bore and the annular channel, providing communication between a fluid volume above said slave piston, the hydraulic fluid supply line and the drain passage when the annular channel and the lower flow port are aligned; an electronic trigger valve connected to a common rail, high-pressure plenum, to the upper flow port via the hydraulic fluid supply line and to the drain passage; a sleeve disposed around the slave piston and contained substantially in the brake housing; and means for maintaining the sleeve in an adjusted position, connected to the sleeve.

In this embodiment, the trigger valve may be a three-way, high-pressure, high-speed trigger valve. The annular channel may provide, in a first position, communication of the fluid volume with the upper flow port and occlusion of the lower flow port, and in a second position, opening of the lower flow port while the upper flow port is nearly occluded, to thereby permit communication between the fluid volume above the slave piston and the drain passage. The annular channel may further comprise a plurality of circumferentially-arranged holes or a plurality of circumferential grooves. The sleeve may further comprise a first set of threads and the brake housing further comprises a second set of threads, the first and second sets of threads being capable of alignment thereby to screw the sleeve into the brake housing. The sleeve may extend above the brake housing, and the sleeve extension further comprises a continuation of the first set of threads. The apparatus may further comprise a locking ring threadably engaged to the sleeve extension, for securing the sleeve in an adjusted position. The sleeve may further comprise at least one vertical bore disposed in the sleeve extension parallel with the longitudinal axis of the slave piston cylinder. The apparatus may further comprise at least one hold-down bolt for securing the sleeve in an adjusted position and a plurality of shims of varying thickness for adjusting the lash of the slave piston. The apparatus may further comprise an adjusting screw threadably engaged with the sleeve.

BRIEF DESCRIPTION OF THE DRAWINGS

The present invention will now be described in connection with the following figures in which like references numbers refer to like elements and wherein.

DETAILED DESCRIPTION OF THE INVENTION

Reference will now be made in detail to preferred embodiments of the stroke-limiting slave piston of the present invention, examples of which are illustrated in the accompanying drawings. A preferred embodiment of the present invention is shown in FIG. 1 as slave piston assembly 10.

Figure 1:
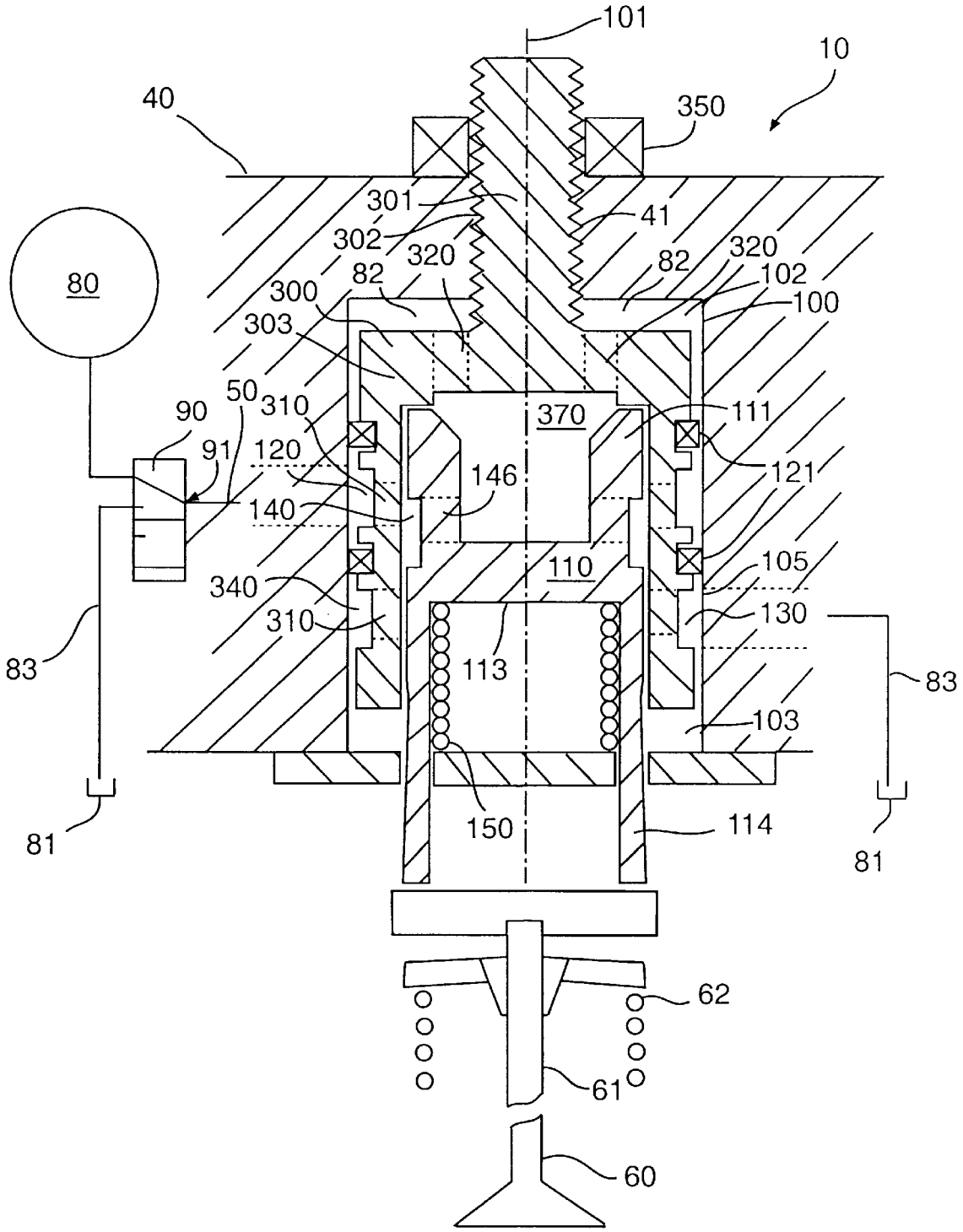
FIG. 1 is a cross-section of a slave piston, the associated hydraulic system, and an engine valve of an embodiment of the present invention.

The embodiment shown in FIG. 1 may be installed in a common rail, variable valve actuation system. As shown in FIG. 1, slave piston assembly 10 generally comprises slave piston cylinder 100, slave piston 110 and spring 150.

As embodied herein, slave piston cylinder 100 comprises wall 105, upper end 102, and lower end 103 and has longitudinal axis 101. Slave piston cylinder 100 further comprises upper flow port 120 and lower flow port 130.

As shown in FIG. 1, slave piston 110 generally comprises head 111 and stem 114 and is centered on longitudinal axis 101 of slave piston cylinder 100. Slave piston 110 comprises annular channel 140 and horizontal bore 146. Annular channel 140 and horizontal bore 146 are preferably disposed in slave piston head 111. In this embodiment of the invention, horizontal bore 146 diametrically spans head 111, with each end of horizontal bore 146 opening within annular channel 140. Slave piston 110 is further provided with plenum 370.

As embodied herein, stem 114 of slave piston 110 extends downward from head 111. Stem 114 is preferably cylindrical in shape, but in other embodiments of the invention may have a square cross-section or other cross-sectional shape. Stem 114 is preferably formed integrally with head 111 of slave piston 110. As embodied herein, stem 114 is slidably disposed in lower end 103 of slave piston cylinder 100.

Spring 150 is disposed within the lower end 103 of slave piston cylinder 100. Spring 150 preferably acts against bottom end face 113 of head portion 111 of slave piston 110. Spring 150 preferably urges slave piston 110 in a generally upward direction.

Slave piston assembly 10 further comprises trigger valve 90 and its associated hydraulic circuit. Trigger valve 90 is connected to common rail plenum 80, hydraulic fluid supply line 50, and drain passage 83. Upper flow port 120 is connected to trigger valve port 91 via hydraulic fluid supply line 50. Trigger valve port 91 is alternately connected to high pressure source (e.g. common-rail plenum 80 at 3500 psi) or to drain 81. Lower flow port 130 is connected to drain 81 via drain passage 83. Annular channel 140 in slave piston head 111 is located such that lower flow port 130 opens at a slave piston displacement slightly less than that at which upper flow port 120 is completely occluded. This may be accomplished by line-on-line porting or even a small overlap when leakage is taken into account.

As embodied herein, an apparatus for lash adjustment independent of stroke limiting includes setting sleeve 300 around slave piston 110, as shown in FIG. 1. Sleeve 300 is provided with threads 302 on threaded end or shank 301. Threads 302 and shank 301 protrude above the top of brake housing 40. Brake housing 40 is also provided with threads 41. By means of threads 302, sleeve 300 is threaded into brake housing 40 so that threads 302 and 41 are aligned. Brake housing 40 is in turn bolted to the engine. Locking ring 350 threads onto that portion of threads 302 and shank 301 that protrude above the top of brake housing 40.

As shown in FIG. 1, at least one vertical bore 320 in the top of sleeve 300 is provided to connect slave piston plenum 370 to oil space 82 above sleeve 300. Pressure area 303, which acts to push sleeve 300 downward, is designed to be somewhat larger than the cross-sectional area of threaded part 301 of sleeve 300 so that the net force on sleeve 300 during valve actuation is downward, in order not to loosen locking ring 350, and to assure that the loading on threads 302 is acceptable.

In a preferred embodiment as shown in FIG. 1, the upper flow port 120 and lower flow port 130 are defined by the mating of a plurality of circumferentially-arranged holes or slots 310 in sleeve 300 with annular channel 140 in slave piston 110. Annular grooves 340 on the outside of sleeve 300 connect flow ports 120 and 130 to hydraulic passages 50 and 83 respectively, and are designed to mate for the worst-case range of lash adjustment. Sealing the connection to upper flow port 120 on the outside of sleeve 300 is provided by O-rings or similar seals 121. The diameter of sleeve 300 and slave piston cylinder 100 may be stepped to facilitate assembly of seals 121. An optional stroke limiting adjusting screw may be threaded in top of sleeve 300.

As embodied herein, slave piston assembly 10 further comprises exhaust valve 60, exhaust valve actuation member 61, and exhaust valve spring 62 provided below slave piston stem 114. FIG. 1 shows slave piston pushing on a bridge. Alternative embodiments which transmit slave piston motion to the engine exhaust valve are included in the innovation.

The operation of the stroke-limiting system according to a preferred embodiment of the invention will now be described in connection with FIG. 1. Travel of slave piston 110 (or, slave piston stroke) is limited by dropping the pressure above slave piston 110 to drain, combined with the force of exhaust valve 60 and slave piston springs 150. Dropping the slave piston pressure to drain while trigger valve 90 is open is accomplished by closing upper flow port 120 between slave piston plenum 370 and trigger valve 90 while opening lower flow port 130 between slave piston plenum 370 and drain 81. As shown in FIG. 1, the upper flow port area is defined by the mating of the upper edge of annular channel 140 in the slave piston 110 with the lower edge of the upper row of circumferentially-arranged holes 310 of sleeve 300. The lower flow port area is defined by the mating in the lower edge of annular channel 140 in slave piston 110 with upper edge of lower row of circumferentially-arranged holes 310 of the sleeve 300.

Initially, trigger valve 90 is positioned to connect upper flow port 120 to drain 81 and slave piston 110 is fully retracted. Upper flow port 120 is open, and lower flow port 130 is closed. When trigger valve assembly 90 is switched to connect upper flow port 120 to common rail high-pressure source 80, high pressure fluid or oil fills slave piston plenum 370 through hydraulic fluid supply line 50 into upper flow port 120, and slave piston 110 begins to move down. As slave piston 110 moves down, the upper flow port 120 is progressively occluded, cutting off the flow of oil to slave piston plenum 370 and arresting the motion of slave piston 110. Lower flow port 130 opens at a piston stroke at which upper flow port 120 is nearly shut off, and oil flows from the piston plenum 370 to drain 81. The inertia of the piston will, in general, lead to overshoot, which will completely shut off upper flow port 120 and further open lower flow port 130. Opening lower flow port 130 to drain 81 ensures that slave piston pressure will be rapidly reduced to drain pressure, even if there is significant entrained air in the hydraulic fluid. It also reduces cavitation problems in slave piston plenum 370, as there is the possibility of back flow of oil from drain line 83 to slave piston plenum 370 during over-stroke. The position of the piston will oscillate and, if there is time before trigger valve assembly 90 switches to drain, converge to a stroke at which both upper 120 and lower 130 flow ports are very slightly open. When trigger valve assembly 90 is switched to drain, oil flows from piston plenum 370 through upper flow port 120 to drain 81, and piston 110 returns to its original position, with the aid of the slave piston spring 150. Positioning lower flow port 130 in brake housing 40 so that lower flow port 130 opens before or at approximately the same time as upper flow port 120 is completely occluded is the key to eliminating a check valve, which is otherwise needed to ensure that slave piston 110 does not get stuck with a hydraulic lock at a stroke at which upper flow port 120 is fully occluded. With appropriate choice of design parameters, the flow of oil from the common rail plenum will be small compared with the capability of the high pressure pump, and the delay in engine valve closing after the trigger valve assembly is switched to drain will be acceptable.

Figure 2:
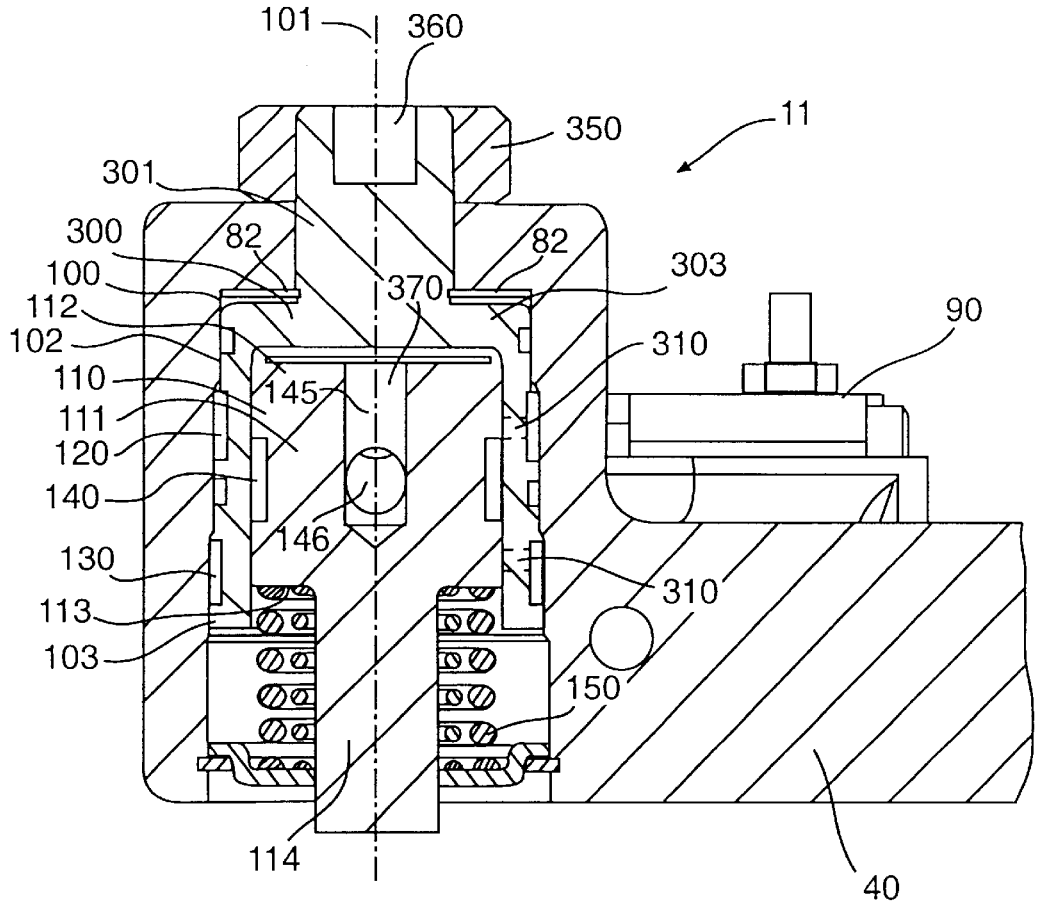
FIG. 2 is a cross-section of a slave piston and trigger valve assembly of an alternate embodiment of the present invention.
Figure 3:
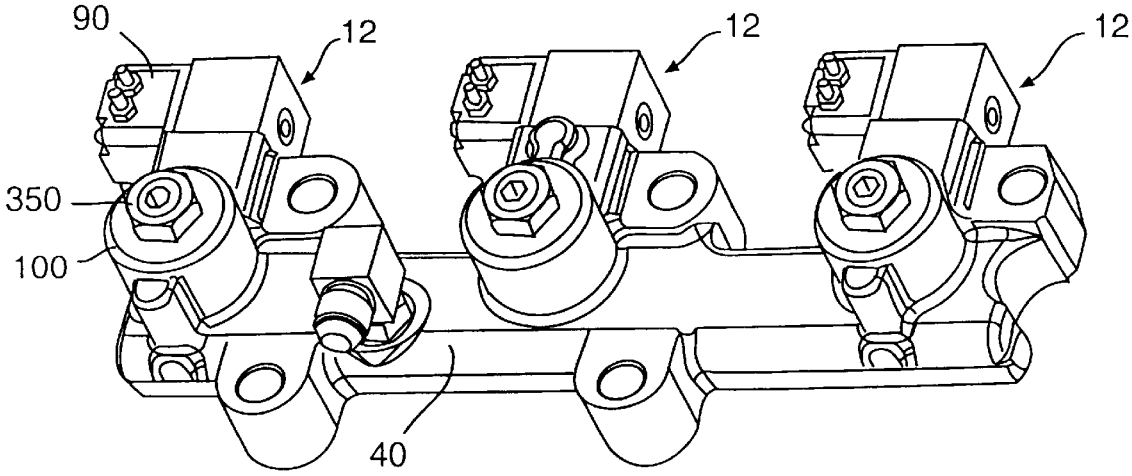
FIG. 3 is an overhead perspective view of the present invention showing a portion of the engine brake housing comprising three slave pistons and their associated high-speed electronic trigger valves.

In an alternative embodiment, slave piston assembly 11 is shown in FIG. 2. Slave piston 110 comprises annular channel 140, horizontal bore 146 and vertical bore 145. Annular channel 140, horizontal bore 146, and vertical bore 145 are preferably disposed in slave piston head 111. Annular channel 140, horizontal bore 146, and vertical bore 145 together form an internal passageway in slave piston 110 that permits flow of hydraulic fluid between slave piston plenum 370 and both upper flow port 120 and lower flow port 130. An optional stroke limiting adjusting screw 360 may be threaded in the top of sleeve 300.

Figure 4:
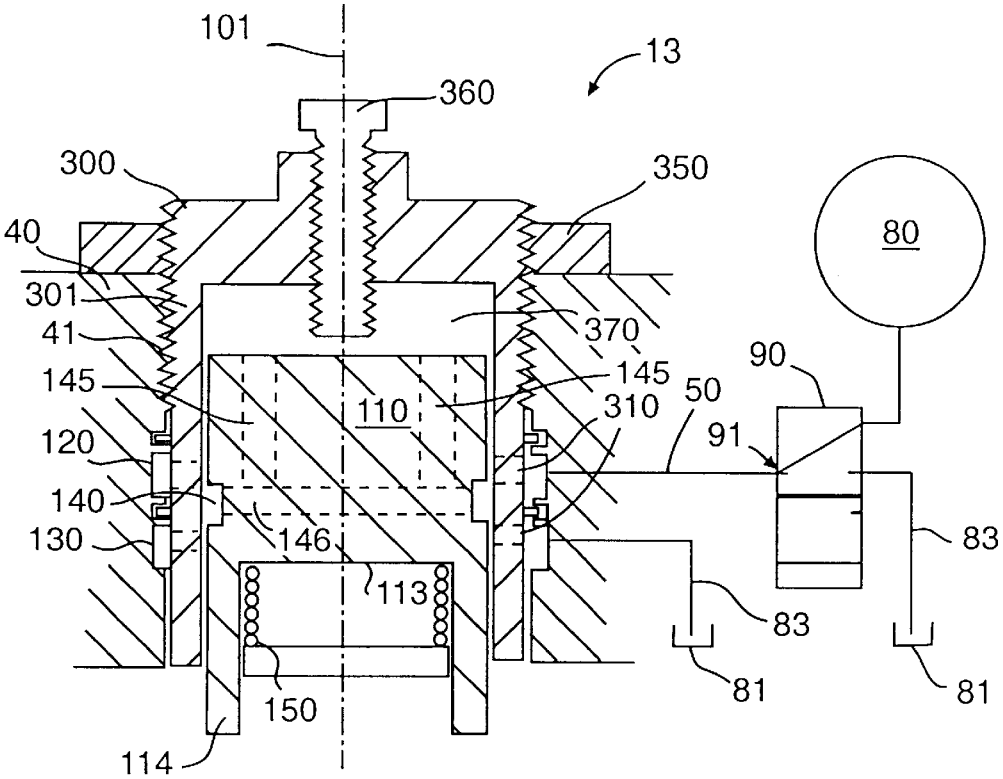
FIG. 4 is a cross-section of a slave piston and the associated hydraulic system of a second alternate embodiment of the present invention with a locking ring.

In a second alternate embodiment, slave piston assembly 13 is shown in FIG. 4. As embodied, herein, the slave piston lash is adjusted by turning sleeve 300 that is threaded into brake housing 40. In this embodiment, locking ring 350 is threaded onto sleeve 300 to prevent change in lash setting due to vibration and cyclic loading. Optional stroke limit adjusting screw 360 may be threaded in the top of sleeve 300.

Figure 5:
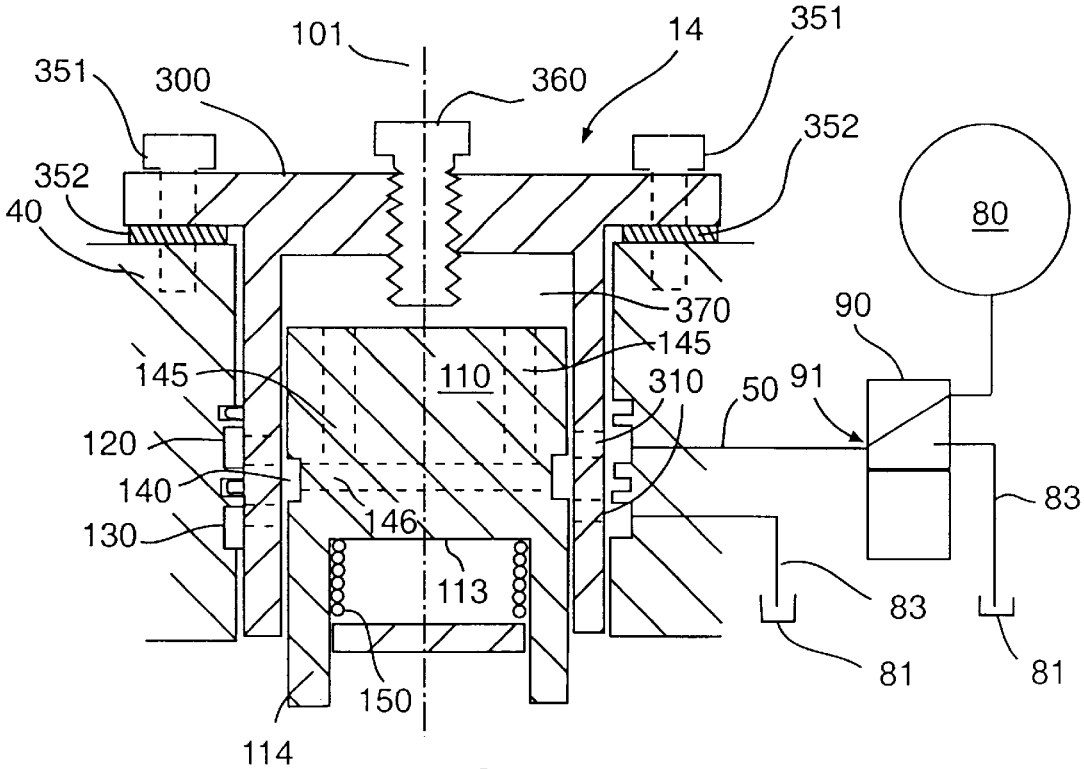
FIG. 5 is a cross-section of a slave piston and the associated hydraulic system of a third alternate embodiment of the present invention with shims and hold-down bolts.

In a third alternate embodiment, slave piston assembly 14 is shown in FIG. 5. Sleeve 300 is secured to brake housing 40 by at least one hold-down bolt 351. The lash may be set by inserting shims 352 of varying thickness between sleeve 300 and brake housing 40 in the vicinity of hold-down bolt 351. Optional stroke limit adjusting screw 360 may be threaded in the top of sleeve 300.

Figure 6:
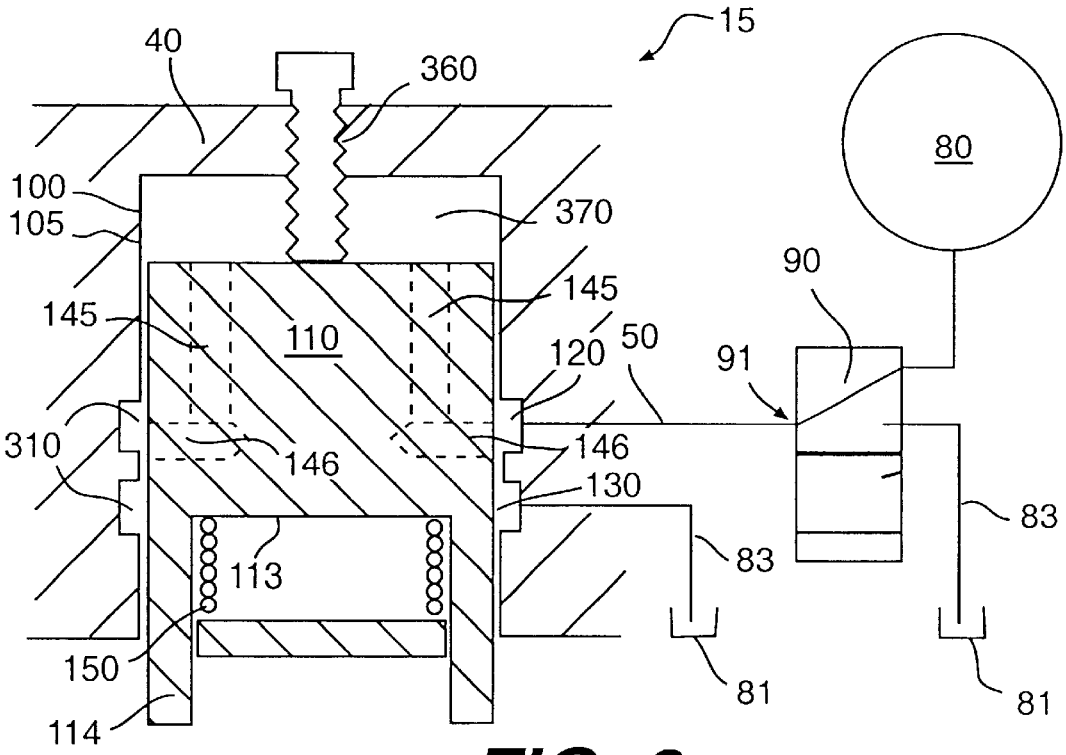
FIG. 6 is a cross-section of a slave piston and the associated hydraulic system of a fourth embodiment of the present invention.
Figure 7:
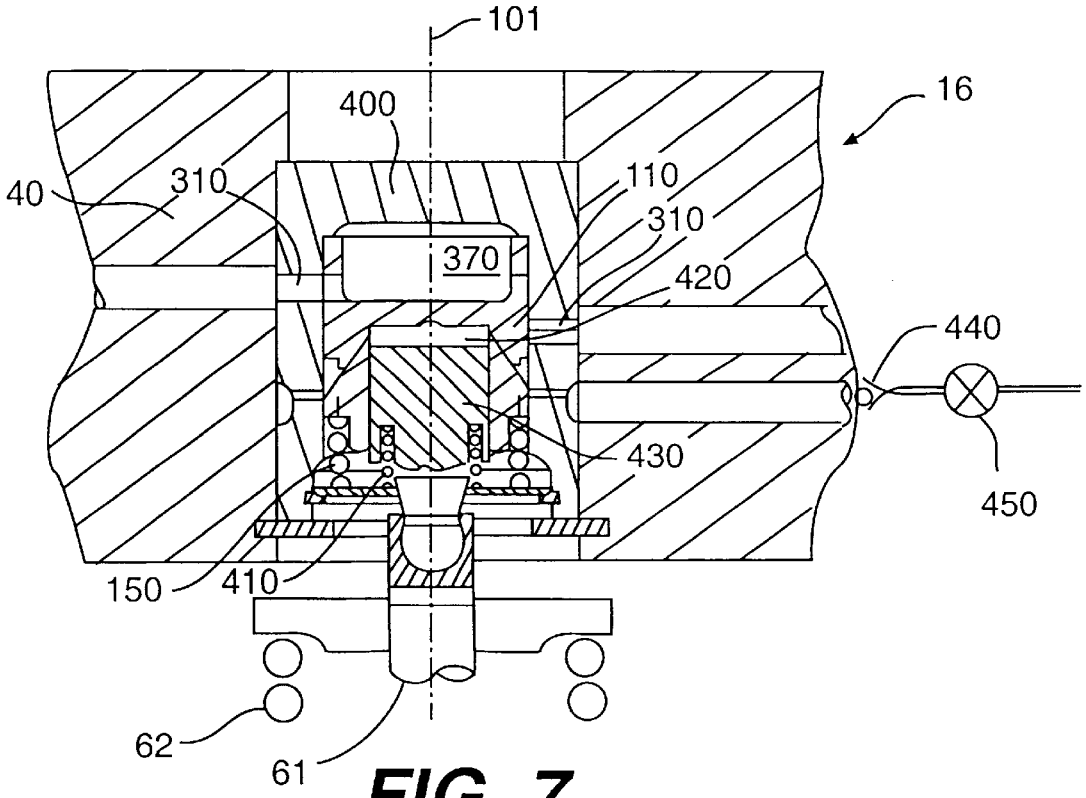
FIG. 7 is a cross-section of a slave piston with an automatic hydraulic lash adjustor of a fifth alternate embodiment of the present invention.

In a fourth alternate embodiment, slave piston assembly 15 is shown in FIG. 6. Feature 310 comprises annular grooves in slave piston cylinder 100, and feature 146 comprises a plurality of circumferentially-arranged holes or slots in slave piston 110. While no means of lash adjustment is shown in FIG. 6, this could be combined with a hydraulic lash adjuster, as shown in FIG. 7 or a mechanical means of lash adjustment in the slave piston foot, as disclosed in copending U.S. patent application Ser. No. 09/241,859 assigned to the same assignee of the present invention. A variation of this embodiment with a sleeve 300 may have annular grooves 310 on the inside to define flow ports 120 and 130, additional annular grooves 340 on the outside to connect flow ports 120 and 130 to hydraulic passages 50 and 83 respectively, and radial holes in sleeve 300 to connect annular grooves 310 and 340.

In a fifth alternate embodiment, slave piston assembly 16 is shown in FIG. 7. As embodied herein, an automatic lash adjustment feature is utilized. Fixed sleeve 400 is secured to brake housing 40 by an interference fit or alternate means.

Slave piston assembly 16 operates as follows: when the compression-release brake is switched on, control valve or solenoid valve 450 switches engine lubrication oil to flow into hydraulic lash adjuster plenum 420, which drives down hydraulic lash adjuster piston 430. Check valve 440 retains the oil in plenum 420 when slave piston 110 opens engine exhaust valve 60. When the brake is switched off, control valve 450 closes, switching off the oil supply to the automatic lash adjustment, thereby preventing the automatic lash adjustor from operating during normal engine operation. The diameter of hydraulic lash adjuster piston 430 is sized so that the force of engine oil pressure acting on the top of hydraulic lash adjuster piston 430 does not exceed the preload of the exhaust valve spring 62. Lash adjuster spring 410 is chosen so that the spring force is always less than the force of engine oil pressure acting on the top of hydraulic lash adjuster piston 430.

It will be apparent to those skilled in the art that various modifications and variations can be made in the construction and configuration of the present invention without departing from the scope and spirit of the invention For example, a variety of materials may be used to construct the components of the apparatus of the invention. In addition, the design innovation of the present invention may be applied to either the slave piston or to a separate stroke-limiting piston located between the high-pressure common rail and the slave piston. Also, various combinations of circumferential grooves, sets of holes or slots may be arranged circumferentially to achieve a given flow area versus piston displacement profile. The adjustable sleeve innovation may be applied to any hydraulic piston stroke-limiting design in which the displacement of the piston beyond a given level causes the arresting motion of the piston and where it is desired to adjust the displacement of the piston when fully retracted relative to a fixed brake housing. Also, the adjustable sleeve may be attached to the brake housing by a variety of fastening devices. Thus, it is intended that the present invention cover the modifications and variations of the invention provided they come within the scope of the appended claims and their equivalents.

What is claimed is:

1. Apparatus in a compression release engine retarder for limiting the travel of a slave piston in a slave piston cylinder disposed in a brake housing, said slave piston having a head and a stem disposed thereon and said slave piston cylinder having a wall and being connected to a hydraulic circuit so that when hydraulic fluid passes through said wall of said slave piston cylinder at an upper end of said slave piston cylinder, said slave piston moves down along a longitudinal axis toward a lower end of said slave piston cylinder to actuate at least one engine valve, said apparatus comprising:

an upper flow port in said slave piston cylinder wall, said upper flow port forming an entrance to a hydraulic fluid supply line;

a lower flow port in said slave piston cylinder wall, said lower flow port forming an entrance to a drain passage; and an internal passageway in said slave piston head, said internal passageway providing communication between a fluid volume above said slave piston, said hydraulic fluid supply line and said drain passage; and an electronic trigger valve connected to a common rail, high-pressure plenum, to said upper flow port via said hydraulic fluid supply line and to said drain passage;

wherein said slave piston head further comprises an annular channel providing, in a first position of said slave piston relative to said brake housing, communication of said fluid volume with said upper flow port and occlusion of said lower flow port, and in a second position of said slave piston relative to said brake housing, opening of said lower flow port while said upper flow port is nearly occluded, to thereby permit communication between said fluid volume above said slave piston and said drain passage, and wherein in said second position, said at least one engine valve is actuated.

2. The apparatus of claim 1, wherein said trigger valve is a three-way, high-pressure, high-speed trigger valve.

3. The apparatus of claim 1, further comprising a slave piston spring disposed in said slave piston cylinder and biased to urge said slave piston generally upward against the pressure in said hydraulic circuit.

4. The apparatus of claim 1, wherein said head of said slave piston is slidably disposed in said upper end of said slave piston cylinder, and said stem of said slave piston extends longitudinally from said slave piston head into said lower end of said slave piston cylinder.

5. The apparatus of claim 1, wherein a first flow area of said upper flow port and a second flow area of said lower flow port vary as a function of the longitudinal position of said slave piston.

6. The apparatus of claim 1, wherein said annular channel further comprises a plurality of circumferentially-arranged holes.

7. The apparatus of claim 1, wherein said annular channel further comprises a plurality of circumferential grooves.

8. The apparatus of claim 1, wherein said internal passageway further comprises a plenum disposed generally in said slave piston head, at least one vertical bore disposed in said slave piston head parallel with said longitudinal axis of said slave piston cylinder, and at least one horizontal bore diametrically spanning said slave piston head, such that said at least one horizontal bore communicates with said slave piston plenum, said at least one vertical bore and said annular channel.

9. The apparatus of claim 1, further comprising an automatic lash adjustment hydraulic system for adjusting the lash of said slave piston.

10. The apparatus of claim 9, wherein said automatic lash adjustment hydraulic system further comprises:

a hydraulic lash adjustor piston slidably disposed inside said slave piston;

a hydraulic lash adjustor spring disposed about said a hydraulic lash adjustor piston to urge said hydraulic lash adjustor piston upward;

a hydraulic lash adjustor plenum between said slave piston and said hydraulic lash adjustor piston;

a check valve between said hydraulic lash adjustor plenum and said hydraulic circuit; and a control valve connected to said hydraulic circuit.

11. Apparatus in a compression release engine retarder for adjusting the lash of a slave piston in a slave piston cylinder, said slave piston having a head and a stem disposed thereon and said slave piston cylinder, disposed in a brake housing, having a wall and being connected to a hydraulic circuit so that when hydraulic fluid passes through an upper flow port and a lower flow port in said wall of said slave piston cylinder, said slave piston moves, relative to said brake housing, down along a longitudinal axis of said slave piston cylinder toward a lower end of said slave piston cylinder to actuate at least one engine valve, said apparatus comprising:

a sleeve disposed around said slave piston and contained substantially in said brake housing, wherein said sleeve further comprises at least one vertical bore disposed in a sleeve extension, wherein said at least one vertical bore is parallel with said longitudinal axis of said slave piston cylinder and connects a first fluid volume above said slave piston with a second fluid volume above said sleeve; and means for maintaining said sleeve in an adjusted position, connected to said sleeve.

12. The apparatus of claim 11, wherein said sleeve further comprises a first set of threads and said brake housing further comprises a second set of threads, said first and second sets of threads being capable of alignment thereby to screw said sleeve into said brake housing.

13. The apparatus of claim 12, wherein said sleeve extension extends above said brake housing, said sleeve extension further comprising a continuation of said first set of threads.

14. The apparatus of claim 13, wherein said apparatus further comprises a locking ring threadably engaged to said sleeve extension, for securing said sleeve in an adjusted position.

15. The apparatus of claim 11, wherein said apparatus further comprises at least one hold-down bolt for securing said sleeve in an adjusted position.

16. The apparatus of claim 15, wherein said apparatus further comprises a plurality of shims of varying thickness for adjusting said lash of said slave piston.

17. The apparatus of claim 13, wherein said apparatus further comprises an adjusting screw threadably engaged with said sleeve.

18. Apparatus, in a compression release engine retarder having a common rail, variable valve actuation system, for limiting the travel and adjusting the lash of a slave piston in a slave piston cylinder, said slave piston having a head and a stem disposed thereon and said slave piston cylinder, disposed in a brake housing, having a wall and being connected to a hydraulic circuit so that when hydraulic fluid passes through said wall of said slave piston cylinder at an upper end of said slave piston cylinder, said slave piston moves down along a longitudinal axis toward a lower end of said slave piston cylinder to actuate at least one engine valve, said apparatus comprising:

an upper flow port in said slave piston cylinder wall, said upper flow port forming an entrance to a hydraulic fluid supply line;

a lower flow port in said slave piston cylinder wall, said lower flow port forming an entrance to a drain passage;

a slave piston spring disposed in said slave piston cylinder and biased to urge said slave piston generally upward against the pressure in said hydraulic circuit;

said slave piston head, slidably disposed in said upper end of said slave piston cylinder, having an annular channel, said annular channel providing, in a first position of said slave piston relative to said brake housing, communication of said fluid volume with said upper flow port and occlusion of said lower flow port, and in a second position of said slave piston relative to said brake housing, opening of said lower flow port while said upper flow port is nearly occluded, to thereby permit communication between said fluid volume above said slave piston and said drain passage, and wherein in said second position, said at least one engine valve is actuated;

said slave piston stem, extending longitudinally from said slave piston head into said lower end of said slave piston cylinder;

an internal passageway in said slave piston, comprising a plenum disposed generally in said slave piston head, at least one vertical piston head bore disposed in said slave piston head parallel with said longitudinal axis of said slave piston cylinder, and at least one horizontal bore diametrically spanning said slave piston head, such that the at least one horizontal bore communicates with said plenum, said at least one vertical piston head bore and said annular channel, providing communication between a fluid volume above said slave piston, said hydraulic fluid supply line and said drain passage when said annular channel and said lower flow port are aligned;

an electronic trigger valve connected to a common rail, high-pressure plenum, to said upper flow port via said hydraulic fluid supply line and to said drain passage;

a sleeve disposed around said slave piston and contained substantially in said brake housing, wherein said sleeve further comprises at least one vertical sleeve bore disposed in a sleeve extension, wherein said at least one vertical sleeve bore is parallel with said longitudinal axis of said slave piston cylinder and connects a first fluid volume above said slave piston with a second fluid volume above said sleeve; and means for maintaining said sleeve in an adjusted position, connected to said sleeve.

19. The apparatus of claim 18, wherein said trigger valve is a three-way, high-pressure, high-speed trigger valve.

20. The apparatus of claim 18, wherein said annular channel further comprises a plurality of circumferentially-arranged holes.

21. The apparatus of claim 18, wherein said annular channel further comprises a plurality of circumferential grooves.

22. The apparatus of claim 18, wherein said sleeve further comprises a first set of threads and said brake housing further comprises a second set of threads, said first and second sets of threads being capable of alignment thereby to screw said sleeve into said brake housing.

23. The apparatus of claim 18, wherein said sleeve extension extends above said brake housing, said sleeve extension further comprising a continuation of said first set of threads.

24. The apparatus of claim 18, further comprising a locking ring threadably engaged to said sleeve extension, for securing said sleeve in an adjusted position.

25. The apparatus of claim 18, further comprising at least one hold-down bolt for securing said sleeve in an adjusted position.

26. The apparatus of claim 18, further comprising a plurality of shims of varying thickness for adjusting the lash of said slave piston.

27. The apparatus of claim 18, further comprising an adjusting screw threadably engaged with said sleeve.

* * * * *